US007721943B2

(12) United States Patent
Perrone et al.

(10) Patent No.: US 7,721,943 B2
(45) Date of Patent: May 25, 2010

(54) TWO WAY ELECTRONIC MEDIA MAILER

(75) Inventors: Dan Perrone, Gurnee, IL (US); Laura Leigh Helfers, Plainfield, IL (US); Jeffrey W. Banks, Elk Grove Village, IL (US); Jon Bartelli, Elgin, IL (US); Harvey Halperin, Kiamesha Lake, NY (US)

(73) Assignee: Moore Wallace North America, Inc., Stamford, CT (US)

( * ) Notice: Subject to any disclaimer, the term of this patent is extended or adjusted under 35 U.S.C. 154(b) by 1290 days.

(21) Appl. No.: 10/937,108

(22) Filed: Sep. 9, 2004

(65) Prior Publication Data

US 2006/0049069 A1 Mar. 9, 2006

(51) Int. Cl.
*B65D 27/06* (2006.01)

(52) U.S. Cl. ..... 229/305; 229/304

(58) Field of Classification Search ..... 229/305, 229/304

See application file for complete search history.

(56) References Cited

U.S. PATENT DOCUMENTS 2,062,776 A * 12/1936 Berkowitz ..... 229/80
3,897,720 A * 8/1975 Hiersteiner ..... 493/216
3,942,714 A 3/1976 Wise
3,977,597 A 8/1976 Wise et al.
4,033,807 A 7/1977 Neill et al.
4,487,360 A 12/1984 Fisher et al.
4,524,903 A 6/1985 Vath
4,762,271 A * 8/1988 Lewyt ..... 229/72
4,899,926 A 2/1990 Spaulding
5,232,087 A 8/1993 Schluger
5,248,082 A 9/1993 Elmlinger
5,267,687 A 12/1993 Sherman
5,333,909 A * 8/1994 Hedge, Jr. ..... 283/56
5,590,912 A * 1/1997 Stevens ..... 283/56
5,603,529 A 2/1997 Breindel
5,803,352 A 9/1998 Spaulding (Continued)

OTHER PUBLICATIONS

Internet World Wide Web page, www.gluefold.com/twoway.htm, printed Aug. 3, 2006.

(Continued)

*Primary Examiner*—Nathan J Newhouse
*Assistant Examiner*—Jack H Morgan, Jr.
(74) *Attorney, Agent, or Firm*—Hanley, Flight & Zimmerman, LLC

(57) ABSTRACT

A two way mailer for conveying an item from a sender to a recipient and back is disclosed. The two way mailer comprises a base panel, a sender address panel, and a recipient address panel. The base panel and the sender address panel may be made from a single contiguous piece of material or from non-contiguous pieces of material. The recipient address panel is preferentially part of the same contiguous material as the base panel and the sender address panel. The sender address panel is affixed by at least one adhesive region to the base panel to form a pocket for containing the item during mailing. The size of the pocket eliminates free space and flushes the item with an edge of the pocket which first enters automated postal processing equipment. In this configuration, a fragile item may be conveyed from the sender to the recipient and from the recipient back to the sender without damage to the item.

19 Claims, 4 Drawing Sheets

U.S. PATENT DOCUMENTS

| | | | | |
|---|---|---|---|---|
| 5,826,787 | A | 10/1998 | Turner | |
| 6,003,760 | A | 12/1999 | Abercrombie | |
| 6,981,587 | B2 | 1/2006 | Gerrie | |
| 2002/0125305 | A1 | 9/2002 | Abercrombie | |
| 2003/0121962 | A1 * | 7/2003 | Hamblin | 229/305 |
| 2003/0230515 | A1 | 12/2003 | Mouyal | |
| 2004/0046010 | A1 | 3/2004 | Colvin, Jr. | |
| 2004/0050919 | A1 * | 3/2004 | Calonje et al. | 229/306 |
| 2004/0256446 | A1 * | 12/2004 | Butler et al. | 229/120.02 |
| 2005/0029135 | A1 | 2/2005 | Gerrie | |
| 2005/0224566 | A1 | 10/2005 | Butler | |
| 2005/0247769 | A1 | 11/2005 | Potter et al. | |
| 2005/0252801 | A1 | 11/2005 | Buck | |

OTHER PUBLICATIONS

Internet World Wide Web page, www.gluefold.com/saledvd.htm, printed Aug. 3, 2006.

Internet World Wide Web page, www.dmia.org/dmiasearch/am_pm/search/srhresults.2.cfm?id=277, printed Aug. 3, 2006.

Internet World Wide Web page, www.onedisc.com/about/release_20060303.php, printed Aug. 3, 2006.

Internet World Wide Web page, http://www.sheppardenvelope.com/envelopes/two-way-boomerang.html, printed Aug. 3, 2006.

Internet World Wide Web page, http://www.environmentaldefense.org/documents/1682_chapter2.pdf, printed Aug. 3, 2006.

Internet World Wide Web page, www.sleevetown.com/dvd-mailer.shtml, printed Aug. 3, 2006.

* cited by examiner

TWO WAY ELECTRONIC MEDIA MAILER

FIELD OF THE INVENTION

The present invention generally relates to mailers and envelopes. The invention relates more specifically to a two way mailer structured to protect a fragile item during both sending and returning the item.

BACKGROUND

Combination envelopes that can carry an item from a sender to a recipient, and back to the sender, are used in several business contexts. For example, in the context of invoicing and payment, multiple-folded envelopes have been used in which an invoice is affixed by a perforation to a reply envelope. The invoice is folded over and sealed to form a closed sending envelope, and an adhesive strip is provided adjacent to the reply envelope. When the customer receives such an envelope or "piece," the customer opens the piece, detaches the invoice, inserts a check for payment in the reply envelope, affixes the adhesive strip, and dispatches the sealed reply envelope in the mail. The use of this past approach, however, has been limited to paper enclosures such as invoices and the like.

The development of the Digital Versatile Disc ("DVD") as a medium for carrying digital movie and video information has led to new rental business models that use postal mail for media transport. For example, Netflix, Inc., of Los Gatos, Calif., offers a DVD rental service in which a subscriber establishes an online "pick list" of DVD movies that the subscriber wishes to rent. When a selected one of the DVD movies on the pick list becomes available in inventory, Netflix mails the selected DVD movie to the subscriber. The subscriber views the DVD and returns it to Netflix by mail. When the DVD is received at Netflix, the subscriber is entitled to receive another available DVD from the pick list.

In this context, however, problems can be encountered as the DVD passes through the postal delivery system. The packaging used to convey the DVD from Netflix to the customer passes through high-speed automatic sorting equipment at postal facilities. Further, the packaging used to convey the DVD from the customer to Netflix passes through high-speed automatic cancellation equipment at postal facilities, during which a postal cancellation mark is applied to the packaging. Because DVDs are manufactured from relatively brittle plastic material, and because the cancellation marks are applied with considerable force, a percentage of DVDs passing through the postal system in this manner are subject to damage, breakage or mutilation. In some cases, the mailers known in the art may not be compatible with automated postal facility equipment. This incompatibility generates additional problems because delays in delivery occur as a consequence of the extra time required to sort the mailers manually.

Another problem relating to two way mailers concerns convenience. Customers of rental approaches, such as the DVD approach described above, demand convenience. When an item is sent to the customer, the customer expects to receive some form of postpaid return packaging with the item. Sending the return packaging separately is not practical or convenient. Accordingly, in this field there is a need for a packaging system in which a sending package and a return package are provided concurrently. Furthermore, customers need a two way mailer with an easy use design. Problems arise when the insertion of the media is too time consuming or difficult for the consumer. Lastly, customers require quick and reliable turn-around times for receipt and return of items.

Based on the foregoing, there is a clear need for a way to package a fragile or breakable item for transport in the postal system from one party to another party in a manner that allows for running through automated equipment and that protects the item from damage, breakage or mutilation. The solution must also provide convenience to customers of rental media. Others have tried to solve the problem by including laminated leading edges of a thickness great enough to ensure the postal cancellation equipment does not come into direct contact with the pocket carrying the breakable object. In these mailers, the DVD is close to the leading edge when the mailer is sent from the sender and close to the trailing edge when the mailer is sent from the recipient. However, the added dimensions of the laminated leading edge results in mailers unable to meet the postal services regulations for first class automatable letters. Because the two way mailers known in the art do not meet first class automatable letters standards, they face an increased postal charge of up to 20%. Furthermore, if mailers are not sent via first class, delivery of the mailer may be delayed. These delays in delivery can be problematic in competitive markets, as customers generally demand quick turn around and on-time delivery from companies renting products such as DVDs. Currently in the United States Postal Service requires that mailers have a maximum height of 6⅛ inches, maximum length of 11½ inches and maximum thickness of ¼ inch in order to qualify for first class automation discounts. The cutoff weight for the most favorable rate for first class automatable delivery is 1 ounce or less.

With the large cost discrepancies between types of two way mailers, the cost of the postage that is incurred by providing customers with the convenience of a return envelop in a rental approach is a major concern to businesses. The average weight of an item such as a DVD in a protective sleeve is approximately 0.58 ounces. On one level, favorable postage rates are achieved when the total weight of the DVD, its protective sleeve, a sending package, and a return package are equal to or less than one ounce. Thus, there is a need for a packaging approach that solves all the foregoing problems and continues to have an average weight of one ounce or less that passes the United States Postal Services requirements for the most favorable rate for first class automatable mail.

Still another issue involves the cost of the packaging materials that are incurred. For a for-profit business engaged in the foregoing rental business, having packaging materials that satisfy all the foregoing requirements and have minimum cost is most desirable. Consequently, there is a need for a packaging approach that solves all the preceding problems in a way that offers minimal cost.

SUMMARY

This invention relates to a two way mailer developed to permit a sender to send digital media such as a DVD to a recipient and have the recipient send the electronic media back in the same mailer. More specifically, the invention relates to a two way mailer having size dimensions allowing favorable first class automated letter postage rates. The invention also relates to a pocket for the electronic media contained within the mailer, which secures and protects the electronic media during mailing.

One aspect of the present invention provides a pocket in the mailer that reduces the amount of free space as compared to two way electronic media mailers known in the art. This reduction in free space constrains the item in the pocket during mailing. The item in the pocket is flushed against the leading edge of the pocket both when the item is initially sent by the sender to the recipient and when the item is sent back by the recipient to the sender. Thus, the item in the pocket is flush to the edge in which the two way mailer enters the automated processing equipment of the United States Postal Service. This way, the item enters the automated processing equipment in the same direction both when the two way mailer is sent from the sender to the recipient and when the two way mailer is sent from the recipient back to the sender. As used herein, "sent" generally means mailed through the United States Postal Service. However, one of skill in the art will understand that "sent" may encompass delivery through alternative systems, such as Federal Express (Fedex) or United Parcel Service (UPS).

Another aspect of the invention provides for added convenience and ease of use for recipients who receive an item in the two way mailer. This added convenience is a result of the fact there are generally only three steps involved for the recipient to return the two way mailer to the sender. These steps include removal of the recipient address panel, insertion of the item, and closure of the recipient address panel adhesive region prior to mailing.

Although not meant to be limiting, embodiments of the invention may be better illustrated by the drawings and detailed description set forth below.

DETAILED DESCRIPTION

Figure 1:
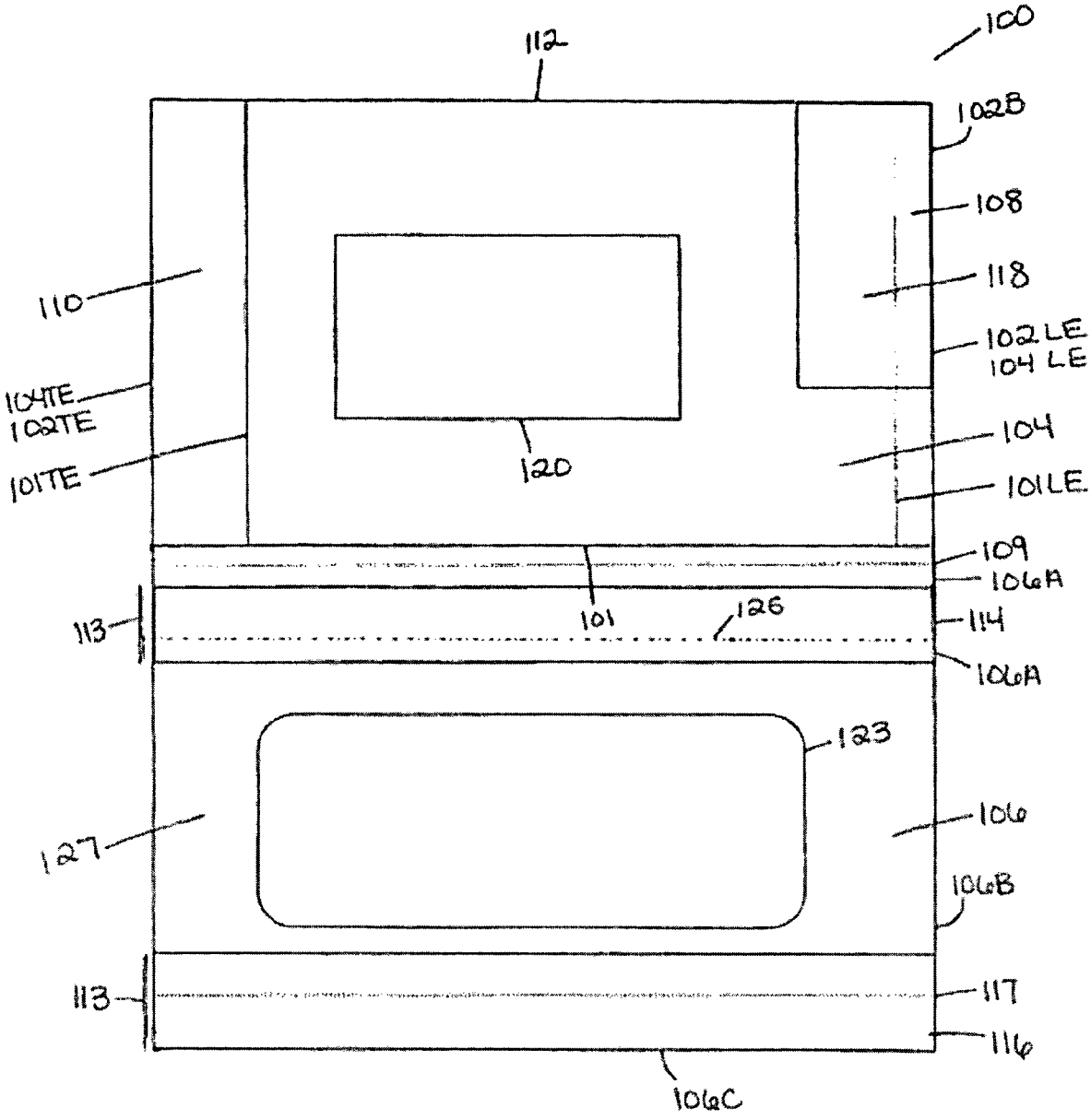
FIG. 1 is a top plan view of a two way mailer.

FIG. 1 is a top plan view of a two way mailer 100 comprising a base panel 102, sender address panel 104, and recipient address panel 106. Base panel 102 and sender address panel 104 each comprise a leading edge 102LE, 104LE, respectively, and a trailing edge 102TE, 104TE, respectively. In this context, "leading edge" refers to an edge that first enters an automatic postal processing machine as two way mailer 100 is processed by the machine, and "trailing edge" refers to an edge that last enters the machine.

Sender address panel 104 may be affixed to base panel 102 by a leading edge adhesive region 108 and a trailing edge adhesive region 110. In certain embodiments, the base panel 102 and sender address panel 104 will be made from a contiguous piece of material with a fold 112. In alternative embodiments, sender address panel and base panel will be made from two separate pieces of material. In these embodiments, a top adhesive region will replace fold 112. This fold or top adhesive region forms a common edge shared by the sender address panel and the base panel. The leading edge adhesive region 108 affixes the leading edge of sender address panel 104 to a corresponding leading edge of base panel 102. A second side adhesive region 110 affixes a second side edge of the sender address panel 104 to a corresponding second side edge of the base panel 102. In some embodiments, the sender address panel 104, base panel 102, leading edge adhesive region 108 and trailing edge adhesive region 110 and fold 112 define a pocket 101 having an open end 101A that may receive an item. In some embodiments, if the sender address panel 104 and the base panel 102 are made from non-contiguous pieces of material, in place of fold 112, a top adhesive region may be used to seal the top edge of the pocket. The pocket comprises a leading edge 101LE and a trailing edge 101TE. In further embodiments, a sleeve that further encloses the item being sent will be adapted to fit into the defined pocket. In these embodiments, the types of sleeves are not limited and may include sleeves commonly used to protect media such as DVDs and CDs. In some embodiments, the sleeves may have advertisements or instructions printed or affixed to them.

Sender address panel 104 is the face of the two way mailer 100 that is exposed to postal authorities or other shipment personnel when the two way mailer is conveyed from a recipient back to a sender. Accordingly, panel 104 may be printed with indicia relating to the sender and postage or other elements relating to properly transporting the two way mailer 100. In one embodiment, a sender address region 120 bears a label, printing or other indicia that identifies a postal address of the sender, and a postage region 118 bears postage, or identifies a postage permit number, or provides an indication that the sender has prepaid postage due for sending the two way mailer 100 back to the sender. Postage region 118 may bear a facing identification mark (FIM), barcode, or other postal service indicia that is readable by automatic handling equipment.

In one embodiment, the base panel 102, sender address panel 104, and recipient address panel 106 are made of paper that bears printed indicia. An example of paper that may be used in certain embodiments includes 50# offset. Embodiments of the invention may also work with 40# and 45# offset as well as matte and glossy paper. One of skill in the art will understand that the printed indicia may be of any form, including but not limited to business identifiers. As an alternative to paper, the base panel 102, sender address panel 104, and recipient address panel 106 may comprise synthetic stock such as polyethylene, or other paper stock such as cardstock, or the like. The skilled artisan understands that the base panel 102, sender address panel 104, and recipient address panel 106 may be made from any material that satisfies the requirements of the invention. The skilled artisan also understands that the mailer of the invention may be made from a contiguous piece or non-contiguous piece of any of the above materials. In embodiments where the base panel, sender address panel, and recipient address panel are not made from a contiguous piece of material, each panel may be made from various materials.

Leading edge adhesive region 108 and trailing edge adhesive region 110 join the base panel to the sender address panel. The leading edge adhesive region and trailing edge adhesive region may comprise water based permanent adhesive. In some embodiments, either Adhering Spine/Pocket Glue or Superior Maching Pocked Glue may be used as the adhesive.

Base panel 102 joins recipient address panel 106 at a fold 109. This fold forms a common edge between the recipient address panel 106 and the base panel 102. Although the embodiment in FIG. 1 demonstrates fold 109 slightly below the bottom edge of pocket 101, one skilled in the art will understand that fold 109 may align with the bottom edge of pocket 101 or may be at any position between the bottom edge of pocket 101 and lower perforation line 125. In some embodiments, a sender address panel adhesive region 114 is defined by an area adjacent to fold 109. Sender address panel adhesive region 114 may have any appropriate adhesive medium for sealing the region 114 onto sender address panel 104, thereby sealing pocket 101 when an item is sent back from a recipient to a sender. As one of skill in the art understands, methods of attachment, in addition to sealing, are contemplated by the invention. Adjacent to sender address panel adhesive region 114, the recipient address panel may also have a lower perforation line 125. When sending an item back to a sender, the recipient may open the perforation and remove most of the recipient address panel 106. Then the recipient may seal the remaining part of the recipient address panel to the sender address panel 104 using the sender address panel adhesive region 114. In one embodiment, the adhesive of the sender address panel adhesive region and/or the recipient address panel adhesive region comprises fugitive glue with a UV barrier used with a quick release strip. When using this type of adhesive, the quick release strip 113 may cover the sender address panel adhesive region 114 and the recipient address panel adhesive region 116. One of skill in the art understands that the dimensions of the quick release strip 113 may either be the same or different depending on whether the strip covers the sender address panel adhesive region 114 or the recipient address panel adhesive region 116. Furthermore, the quick release strip 113 need not be rectangular in dimension. In some embodiments, the adhesive used for the strips may be Perm PSHM for Stickers or Waterbase Perm PSA for stickers. In these or alternative embodiments, the UV barrier coating may be Cationic Silicone or free radical silicone. In certain embodiments, each of the folds described herein may function, additionally or alternatively, as a detachable joint. Furthermore, the lower perforation line discussed above, as well as the additional perforation lines discussed below, including the longitudinal perforation line and the perforation line in the additional piece of material, may also function as a detachable joint. In certain embodiments, the perforations will be formed using seven perforation teeth per inch (7 TPI). However, as one of skill in the art understands, any type of perforation, including those with either greater or lesser numbers of teeth per inch, may be used.

Recipient address panel 106 has an inside face 106A and outside face 106B. The inside face 106A of recipient address panel 106 has an advertising area 123. In some embodiments, this advertising area will be printed with instructions on how to use the two-way mailer or how to use the enclosed media. In some embodiments, the advertising area 123 will be formed from a contiguous piece of material. In certain other embodiments, the advertising area 123 will be formed from a non-contiguous additional piece of material 127 that is affixed to the inside face of 106A. This additional piece of material 127 helps to cushion and stabilize the item when it is sent from the sender to the recipient. In some embodiments, this additional piece of material 127 will contain coupons that can be removed from the recipient address panel. In other embodiments, the additional piece of material may be personalized to the particular recipient. A non-limited example of a personalized message includes information about items that may be of interest to the recipient, such as DVDs of interest. Furthermore, billing information may be included on the additional piece of material.

Figure 2:
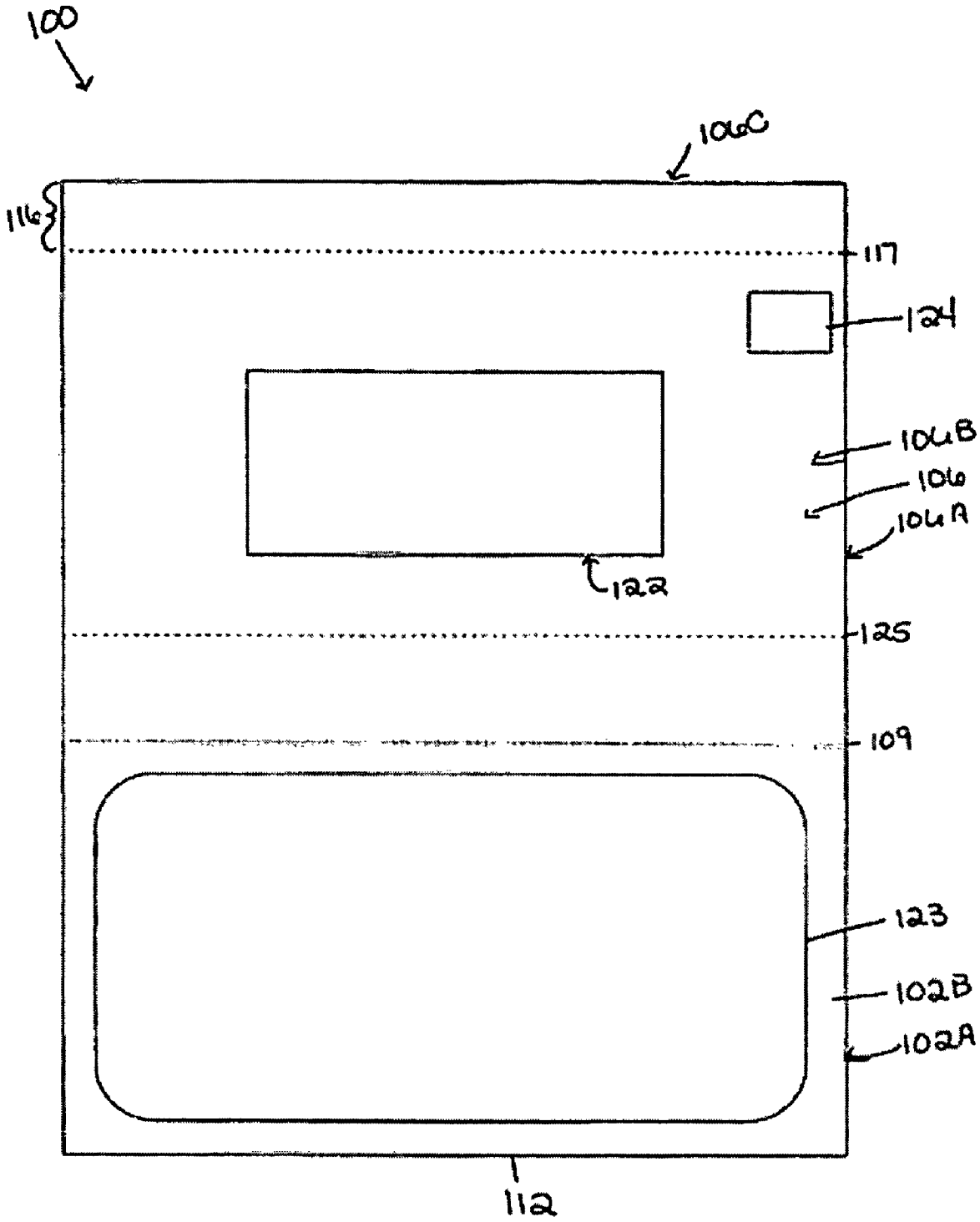
FIG. 2 is a plan view of the opposite side of the two way mailer of FIG. 1.

As demonstrated by the embodiment of FIG. 2, a distal end 106C of inside face 106A may be provided with a longitudinal perforation line 117 adjacent to a recipient address panel adhesive region 116, which may have any appropriate adhesive medium for sealing the recipient address panel adhesive region 116 onto the outside face 102B of base address panel, thereby sealing the entire two way mailer 100 and closing the pocket 101 when an item is sent from a sender to a recipient. Certain embodiments use quick release strips and fugitive glue with a UV barrier as the adhesive. When using this type of adhesive, the quick release strip may cover the recipient address panel adhesive region.

The outside face 106B of recipient address panel 106 is the face of the two way mailer 100 that is exposed to postal authorities or other shipment personnel when the two way mailer is conveyed from a sender to a recipient. Accordingly, outside face 106B may be printed with indicia relating to the recipient and postage or other elements relating to properly transporting the two way mailer 100. As shown in the embodiment of FIG. 2, a recipient address region 122 bears a label, printing or other indicia that identifies a postal address of the recipient; and a postage region 124 bears postage, or identifies a postage permit number, or provides an indication that the sender has prepaid postage due for sending the two way mailer 100 to the recipient. In some embodiments, the label and/or postage will be in the form of an attachable adhesive label. In other embodiments, the label will be printed directly on the on the material of the two way mailer.

In manufacturing some embodiments, panels 102, 104, and 106 may be formed as a contiguous sheet that is folded at edge 112 and fold 109 using suitable folding equipment. One advantage of this embodiment is that the entire two-way mailer may be assembled and printed in-line. In this embodiment, a single printing press may be used to print, fold and attach adhesive to the two way mailer. The use of a completely in-line manufacturing process for the two way mailer provides numerous advantages such as an increase in manufacturing efficiency and a decrease in manufacturing costs. Alternatively, panels 102 and 106 may be formed as a contiguous sheet that is folded at fold 109 using suitable folding equipment, and panel 104 may be attached to panel 102.

The dimensions of panels 102, 104, and 106 may vary in different embodiments. In an embodiment that qualifies for transport by the United States Postal Service as the most favorable rate of "first class automatable letter" mail, rather than as a "non-automatable letter," the height of individual panels 102, 104 and 106 when the mailer is sealed as measured in the up-and-down direction of FIG. 1 is no more than 5.5", and each panel has an overall width of about 7⅛". In some embodiments, it will be advantageous to minimize the amount of material used for the two way mailer so that the mailer plus the item weighs equal to or less than 1 ounce.

Figure 3:
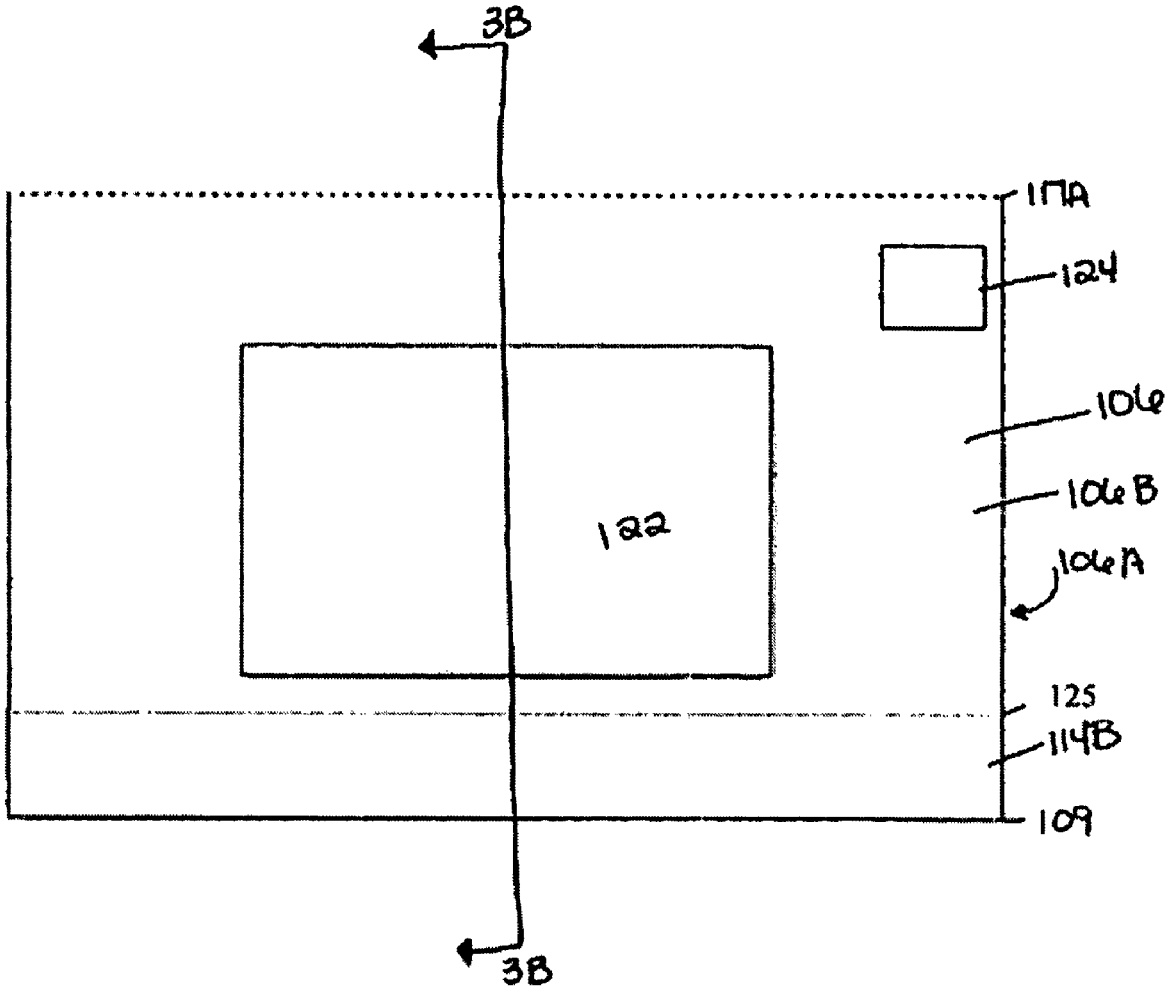
FIG. 3 is a top plan view of the two way mailer of FIG. 1 in a folded configuration for sending an item from a sender to a recipient.
Figure 4:
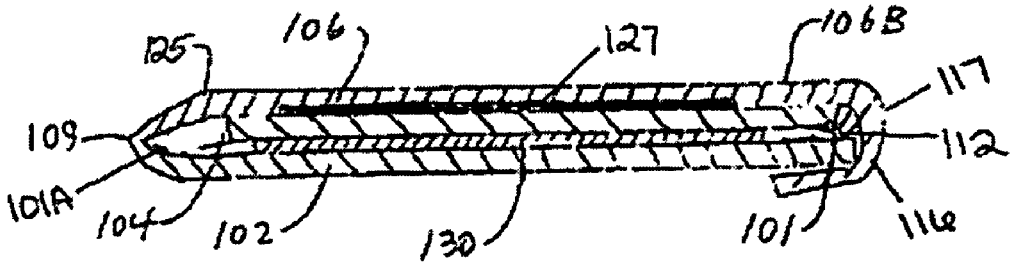
FIG. 4 is a sectional view of the two way mailer of FIG. 3 taken along line 3B-3B of FIG. 3.

FIG. 3 is a top plan view of the two way mailer of FIG. 1 in a folded configuration for sending an item from a sender to a recipient. As one of skill in the art will understand, as used herein, a recipient may include the person or business to whom the two way mailer is addressed. A recipient may also include someone who receives the two way mailer by means other than through the mail. For example, a recipient may include any member of a household residing at the recipient address regardless of the recipient name printed on the mailer. FIG. 4 is a sectional view of the two way mailer of FIG. 3 taken along line 3B-3B of FIG. 3. In FIG. 4, as well as in FIG. 6, the thickness of panels is depicted in greatly exaggerated form, so that the relationship of panels in a folded configuration is clear. In most embodiments, the thickness of the panels when taken together with the item will be less than ¼ inch, so that the two way mailer may meet first class automatable letter standards.

In the embodiment of FIG. 3 and FIG. 4, an item 130 is carried in the pocket 101 defined by base panel 102 and sender address panel 104. Recipient address panel 106 is folded at fold 109 over sender address panel 104 such that outside face of recipient address panel 106B is exposed to postal authorities or other methods of transport. Recipient address panel adhesive region 116 is folded at longitudinal perforation line 117 around and under base panel 102 and sender address panel 104 such that the adhesive of the recipient address panel adhesive region 116 affixes recipient address panel 106 to base panel 102.

In folded and secured arrangement, the item may be conveyed from the sender to the recipient. Upon receipt, the recipient opens the two way mailer 100 by opening longitudinal perforation line 117. Once longitudinal perforation line 117 is opened, the perforated edges may be demonstrated by 117A. Advantageously, in some embodiments, the recipient address panel adhesive region 116 remains attached to the base panel 102 when the recipient opens the longitudinal perforation line 117. This provides a benefit of reducing the small strip of trash often found when many two way mailers are opened. Thus, if the recipient does not want to discard the recipient address panel 106 when opening the two way mailer, no trash is created. This advantage coexists with the advantage of a tight seal that prevents the items in the mailer from exiting the pocket during mailing. Once the two way mailer is opened, the recipient may then open recipient address panel 106 by moving it in a downward direction with respect to FIG. 3. The recipient may break lower perforation line 125 and discard most of recipient address panel 106. When the lower perforation line has been opened, the perforated edges may be identified by 125A. In embodiments where an additional piece of material 127 is used over the inside face 106A of the recipient address panel, the additional piece of material 127 will also have a perforation line corresponding to lower perforation line 125. This additional perforation line keeps the additional piece of material 127 from being torn when the recipient address panel 106 is discarded. The skilled artisan will understand that the additional piece of material 127 will not need to have a perforation line corresponding to perforation line 125 if the additional piece of material 127 is small enough not to overlap lower perforation line 125 on the recipient address panel 106. In some embodiments, the additional piece of material 127 will not be placed over the inside face 106A of the recipient address panel. In these embodiments, printed messages, including advertising may be placed directly on the inside face 106A of the recipient address panel. In other embodiments, the additional piece of material 127 will be formed with the base panel 102, sender address panel 104, and recipient address panel 106 as a contiguous piece of material. Following formation as a contiguous piece of material, the additional piece of material 127 may be later adapted to specific sizes to fit over the inside face 106A of the recipient address panel. Once the two way mailer is opened, the recipient may remove the item 130 from pocket 101 by sliding it in a downward or upward direction.

Figure 5:
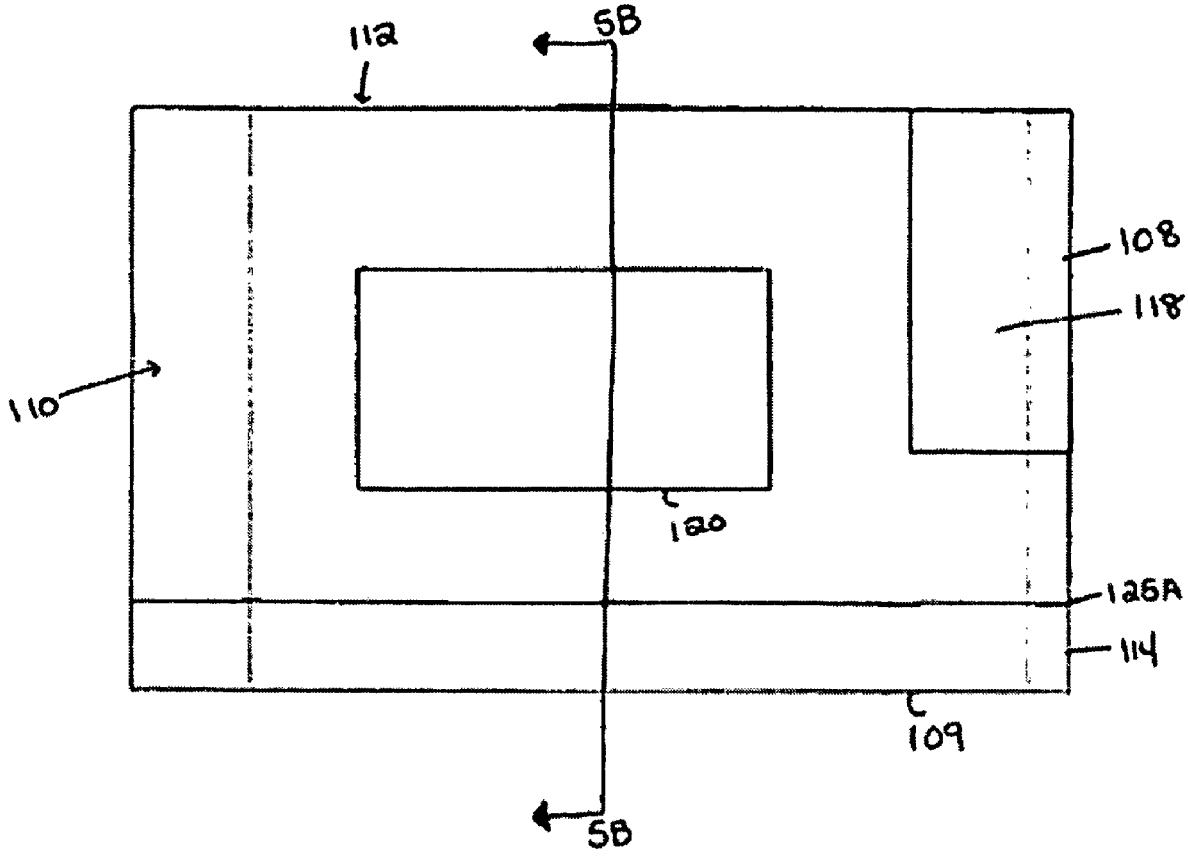
FIG. 5 is a top plan view of the two way mailer side shown in FIG. 2 in a folded configuration for sending an item from a recipient to a sender.
Figure 6:
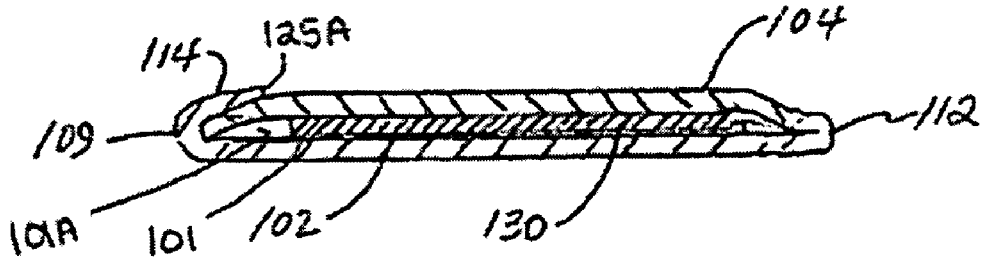
FIG. 6 is a sectional view of the two way mailer of FIG. 5 taken along line 5B-5B of FIG. 5.

To return the item to the sender the recipient re-inserts the item 130 into pocket 101. Then, if not already done, the recipient removes the recipient address panel 106 by breaking perforation 125 and perforation 127 if present. The recipient then removes the quick release strip 113 from the sender address panel adhesive region, folds the sender address panel adhesive region 114 on fold line 109 and seals the sender address panel adhesive region 114 to sender address panel 104. The two way mailer 100 is then arranged as seen in FIG. 5 and FIG. 6 and is ready for transport back to the sender. In most cases, the response item sent back to the sender will be the same item as that sent to the recipient in the two way mailer. Nevertheless, the skilled artisan understands that the response item need not be the exact item sent by the sender but must only be an item that benefits from the other constraints of the invention. A non-limiting example includes the recipient sending back a music CD or a video game when a movie DVD was sent by the sender.

FIG. 5 is a top plan view of the two way mailer of FIG. 1 in a folded configuration for returning an item from a recipient to a sender. FIG. 6 is a sectional view of the two way mailer of FIG. 5 taken along line 5B-5B of FIG. 5. In this arrangement, an item 130 is enclosed in pocket 101 as defined by base panel 102 and sender address panel 104. Sender address panel adhesive region 114 is folded at fold line 109 over sender address panel 104 and its adhesive affixes to sender address panel 104, so that base panel 102 and sender address panel 104 form a closed two way mailer. Sender address indicia are visible to postal authorities or other transport equipment or personnel in sender address region 120.

In one example embodiment, the pocket 101 is sized to receive a generally planar media item such as a Digital Versatile Disk (DVD), Compact Disk (CD), CD-ROM, etc. In this embodiment, base panel 102 and sender address panel 104 have overall length dimensions of approximately 5.5" and overall width dimensions of 7⅛", and leading edge adhesive region 108 and trailing edge adhesive region 110 have width dimensions of approximately ½" and 1½", respectively. Surprisingly and unexpectedly, it was found that having a larger adhesive area on the trailing edge provides less item breakage than having a larger adhesive area on the leading edge. This is true, even when the two way mailer is used with automated postal processing equipment. In certain embodiments, pocket 101 may have an approximate size of 5.75" by 5.5"

In some embodiments, the size of the trailing edge adhesive region 110 reduces the free space of the pocket. This reduction in free space flushes the item along the leading edge of the pocket. This embodiment may result in a two way mailer where the item is less likely to get destroyed or smashed during processing. However, one of skill in the art understands that the size and configuration of the pocket is determined by all the properties of the invention; thus, any specific pocket size dimensions are meant to be non-limiting. The skilled artisan understands that as well as snugly fitting electronic media, the pocket may accommodate other items and have other configurations.

One of skill in the art understands that the two way mailers are not limited to use with the mailing system of the United States Postal Service. Certain embodiments of the two way mailer may be sent from a sender to a recipient and back to a sender using alternative shipping companies such as Federal Express, United Parcel Service (UPS) or the like. One of skill in the art will understand that when used herein, "mailing" may refer to use of any of these carriers.

In some embodiments, the leading edge adhesive region and trailing edge adhesive region may be formed as a plurality of distinct adhesive sub-regions, which reduce the amount of adhesive required per two way mailer without detracting from the integrity provided by the presence of adhesive. This type of adhesive region is demonstrated by U.S. Patent Application 2004/0050919, herein incorporated by reference. In alternative arrangements, any number of adhesive sub-regions in different configurations may be used. For example, the adhesive sub-regions may be either in a contiguous or non-contiguous configuration. Generally, the selection of the form and arrangement of the leading edge adhesive region and trailing edge adhesive region may relate to an amount of postage that a business sender is willing to pay when sending two way mailers 100 to recipients. For example, the two way mailer 100 in the embodiment of FIG. 1 is expected to have an approximate weight of 0.29 ounce; when an item is placed in the two way mailer, it is desirable in some embodiments for the item and two way mailer to weigh equal to or less than one ounce in total, so that extra postage does not apply. In some embodiments, changing the amount of adhesive used for the leading edge adhesive region and trailing edge adhesive region can determine whether a two way mailer and item weigh more than one ounce.

Other alternative embodiments of the two way mailer may exist. As a non-limiting example, a perforated strip may be used in place of simple perforations. Perforated strips allow upward or downward pulling on a portion of strip, making the two way mailer easier to open and the recipient address panel easier to remove. Although the two way mailer may also be easier to open with the use of perforated strips, their use provides a disadvantage of extra trash. In some embodiments, the perforated strips will have one or more perforated tabs formed at the top and bottom of the strip, to facilitate a recipient grasping and pulling on the strip. These tabs may be either curved or arcuate, although one of skill in the art understands that the shape of the perforated tab may vary.

As will be understood by one skilled in the art, all language such as "up to," "at least," "greater than," "less than," and the like include the number recited and refer to ranges which can be subsequently broken down into subranges.

Those knowledgeable in the art will appreciate that the device of the invention may also lead to numerous additional benefits and advantages. Moreover, those knowledgeable in the art will appreciate that the exemplary device of the invention shown and described herein are but exemplary embodiments, and that many equivalent and alternative embodiments exist within the scope of the invention. Accordingly, discussion made herein should not be interpreted as a limitation of the scope of the claimed invention.

While preferred embodiments have been illustrated and described, it should be understood that changes and modifications can be made therein in accordance with ordinary skill in the art without departing from the invention in its broader aspects as defined in the following claims.

What is claimed is:

1. A two way mailer, comprising:

a base panel including a leading edge, a trailing edge opposite the leading edge, an inside face, and an outside face opposite the inside face;

a recipient address panel integral to the base panel wherein the recipient address panel and the base panel share a first common edge different from and extending between the leading edge and the trailing edge;

a sender address panel integral to the base panel wherein the sender address panel and the base panel share a second common edge distal to the first common edge, and different from and extending between the leading edge and the trailing edge, further wherein the sender address panel includes at least one first adhesive region, wherein the at least one first adhesive region affixes the sender address panel to the inside face of the base panel;

a sender address region disposed on the sender address panel;

a single pocket defined by the affixed region of the base panel and the sender address panel, wherein the pocket is closer to the leading edge of the base panel than the trailing edge of the base panel, and wherein the pocket opens adjacent to the first common edge;

a recipient panel flap integral to the recipient address panel wherein the recipient panel flap and the recipient share a third common edge extending between the leading edge and the trailing edge;

a recipient address region disposed on the outside face of the recipient address panel;

a second adhesive region disposed along the recipient panel flap, wherein the second adhesive region affixes the recipient panel flap to the outside face of the base panel such that the recipient address panel substantially covers the sender address panel when the base panel is folded about the first common edge thereby hiding the sender address region, and such that the recipient address region is visible;

a longitudinal perforation line parallel to the first common edge, located distal to the first common edge on the recipient address panel and extending between the leading edge and the trailing edge such that the portion of the recipient address panel containing the recipient address region may be removed from the base panel;

a third adhesive region disposed between the first common edge and the longitudinal perforation line; and a removable liner disposed over the third adhesive region, wherein when the removable liner is removed, the second adhesive region adheres to the inside face of the base panel to substantially close the formed pocket and to expose the sender address region.

2. The two way mailer of claim 1 wherein the sender address panel comprises a same contiguous piece of material as the base panel.

3. The two way mailer of claim 2 wherein the recipient address panel comprises the same contiguous piece of material as the base panel and the sender address panel.

4. The two way mailer of claim 1, further comprising an advertising area integral to the recipient address panel.

5. The two way mailer of claim 4 wherein the advertising area comprises an additional non-contiguous piece of material.

6. The two way mailer of claim 4 wherein the advertising area comprises information personalized for a recipient.

7. The two way mailer of claim 3, further comprising an advertising area integral to the recipient address panel, wherein the advertising area includes advertisements printed directly on the recipient address panel.

8. The two way mailer of claim 1 wherein at least one of the adhesive regions comprises a plurality of sub-adhesive regions.

9. The two way mailer of claim 1 wherein the at least one first adhesive region comprises a leading edge adhesive region and a trailing edge adhesive region opposite the leading edge adhesive region, further wherein the leading edge adhesive region and the trailing edge adhesive region seal a leading edge and a trailing edge opposite the leading edge of the sender address panel to the leading edge and the trailing edge of the base panel.

10. The two way mailer of claim 1 wherein the base panel, the sender address panel, and the recipient address panel comprise one or more non-contiguous pieces of material.

11. The two way mailer of claim 10 wherein the at least one first adhesive region comprises a leading edge adhesive region, a trailing edge adhesive region opposite the leading edge adhesive region and a top adhesive region perpendicular to the trailing edge adhesive region and the leading edge adhesive region, further wherein the leading edge adhesive region and the trailing edge adhesive region seal a leading edge and a trailing edge opposite the leading edge of the sender address panel to the leading edge and the trailing edge of the base panel, further wherein the top adhesive region seals a top edge of the sender address panel to a top edge of the base panel.

12. The two way mailer of claim 1 wherein the pocket receives an electronic media item.

13. The two way mailer of claim 12 wherein the electronic media item is a digital versatile disk (DVD).

14. The two way mailer of claim 1 wherein the base panel, the sender address panel, and the recipient address panel are rectangular.

15. The two way mailer of claim 1 wherein a recipient may open the longitudinal perforation line to gain access to an item in the pocket.

16. The two way mailer of claim 1 wherein a label attaches to the recipient address region, further wherein the label includes a recipient address.

17. The two way mailer of claim 1 wherein the two way mailer meets United States Postal Service most favorable rates for automatable first class letters.

18. The two way mailer of claim 1 wherein the sender address region includes alphanumeric text imaged parallel to the first common edge.

19. The two way mailer of claim 1 wherein the recipient address region includes alphanumeric text imaged parallel to the first common edge.

* * * * *